US012497968B2

(12) United States Patent
Lee et al.

(10) Patent No.: US 12,497,968 B2
(45) Date of Patent: Dec. 16, 2025

(54) ELECTRIC WATER PUMP

(71) Applicant: COAVIS, Sejong-si (KR)

(72) Inventors: Hyuntae Lee, Sejong-si (KR); Wookeun Lee, Sejong-si (KR)

(73) Assignee: COAVIS, Seong-si (KR)

( * ) Notice: Subject to any disclaimer, the term of this patent is extended or adjusted under 35 U.S.C. 154(b) by 1 day.

(21) Appl. No.: 19/077,727

(22) Filed: Mar. 12, 2025

(65) Prior Publication Data

US 2025/0290515 A1 Sep. 18, 2025

(30) Foreign Application Priority Data

Mar. 13, 2024 (KR) ..... 10-2024-0035061

(51) Int. Cl.

| | |
|---|---|
| ***F04D 13/06*** | (2006.01) |
| ***F04D 1/00*** | (2006.01) |
| ***F04D 29/22*** | (2006.01) |
| ***F04D 29/42*** | (2006.01) |

(52) U.S. Cl.

CPC ..... *F04D 13/06* (2013.01); *F04D 1/00* (2013.01); *F04D 29/22* (2013.01); *F04D 29/426* (2013.01)

(58) Field of Classification Search

CPC ..... F04D 13/06; F04D 13/0633; F04D 1/00; F04D 29/041; F04D 29/043; F04D 29/046; F04D 29/051; F04D 29/0513; F04D 29/22; F04D 29/426

See application file for complete search history.

(56) References Cited

U.S. PATENT DOCUMENTS

| | | | | |
|---|---|---|---|---|
| 3,288,073 | A * | 11/1966 | Pezzillo | F04D 13/06 417/357 |
| 6,322,335 | B1 * | 11/2001 | Shi | F04D 29/0413 417/365 |
| 8,961,154 | B2 * | 2/2015 | Yi | F04D 13/064 417/423.7 |
| 2011/0305562 | A1 * | 12/2011 | Matsunaga | F04D 13/0633 415/206 |
| 2018/0128279 | A1 * | 5/2018 | Ogawa | F04D 29/046 |
| 2020/0080571 | A1 * | 3/2020 | Graichen | F04D 29/046 |
| 2022/0403852 | A1 * | 12/2022 | Pae | F04D 29/046 |
| 2024/0052844 | A1 * | 2/2024 | Lee | F04D 29/046 |

FOREIGN PATENT DOCUMENTS

KR 20210009955 A 1/2021

* cited by examiner

*Primary Examiner* — Craig M Schneider
(74) *Attorney, Agent, or Firm* — DICKINSON WRIGHT PLLC

(57) ABSTRACT

Provided is an electric water pump including: a lower casing to which the bottom of a shaft is fixed; an upper casing coupled to the top of the lower casing and including an upper support part extending from the inside; an impeller inserted into an internal space formed by coupling the lower casing with the upper casing and having a thrust plate coupled thereto; and a rotor formed integrally with the impeller, wherein an upper side of the thrust plate is supported by the upper support part and a lower surface of the thrust plate is supported by the top of the shaft. In this way, the impeller and the rotor may be supported on both sides of a central axis, and a frictional force occurring between the parts in contact with each other and rotated relatively may be minimized, thereby improving efficiency and reducing noise.

15 Claims, 7 Drawing Sheets

ELECTRIC WATER PUMP

CROSS-REFERENCE TO RELATED APPLICATIONS

This application claims the benefit of priority under 35 U.S.C. § 119 to Korean Patent Application No 10-2024-0035061, filed Mar. 13, 2024, the contents of which are incorporated herein by reference in its entirety.

TECHNICAL FIELD

The following disclosure relates to an electric water pump that pumps a fluid by rotating an impeller driven by a motor.

BACKGROUND

A water pump is a device for circulating cooling water to an engine or a heater for engine cooling or interior heating. The water pumps are largely classified into a mechanical water pump and an electric water pump, and the electric water pump, which is driven by a rotation of a motor controlled by a control device, is mainly used.

In general, the electric water pump includes a housing, a stator, and a rotor, which are included in a motor unit, and an impeller and an impeller casing, which are included in a pump unit. The stator may be disposed inside the housing and fixed to the housing, the rotor may be disposed to be spaced apart from the inside of the stator, the impeller may be coupled to a rotational axis of the rotor, and the impeller casing may be coupled to the housing to cover up the impeller. In addition, the rotor may be formed integrally with the impeller and accommodated in a concavely formed accommodation space in the impeller casing, and the impeller may be accommodated inside the impeller casing. In addition, the bottom of a shaft may be fixed to the impeller casing by molding or the like, a through hole may be formed in a rotational center of each of the rotor and the impeller, thus enabling a bushing to be pressed into and fixed thereto, and the shaft may be inserted into the bushing, thus enabling the rotor and the impeller to be rotatably coupled to the shaft.

Here, thrust may occur toward a central axis of the impeller when the impeller is rotated. Accordingly, a snap ring, washer, or the like may be coupled to the top of the shaft that is exposed toward the impeller by passing through the rotor and the impeller, thereby supporting an upper side of the impeller. That is, this structure may prevent the impeller from being moved upward due to the thrust occurring in an upward direction when the impeller is rotated.

However, when the impeller is rotated, the snap ring, the washer, or the like coupled to the top of the shaft may come into contact with the impeller or the bushing by the thrust, which increases frictional force, thereby lowering efficiency of the water pump and increasing noise.

Related Art Document

Patent Document

KR 10-2021-0009955 A (Jan. 27, 2021)

SUMMARY

An embodiment of the present disclosure is directed to providing an electric water pump in which a rotor and an impeller are supported on both sides of a central axis and frictional force is minimized by implementing point contact between parts that are in contact with each other and rotated relatively.

In one general aspect, an electric water pump includes: a lower casing including a rotor accommodation part protruding downward and having a rotor accommodation space formed to be concave downward from an upper surface; a shaft disposed inside the rotor accommodation part of the lower casing and having its bottom fixed to the bottom of the rotor accommodation part and extending upward; an impeller disposed on the top of the lower casing and having a thrust plate coupled to its center to dispose a lower surface of the thrust plate to be adjacent to the top of the shaft; a rotor formed integrally with the impeller, having a through hole formed in its center and open vertically to enable the shaft to be inserted into the through hole, and inserted into the rotor accommodation space of the lower casing to be rotatable together with the impeller; and an upper casing coupled to the top of the lower casing, forming an impeller accommodation space therein by being coupled with the lower casing, including an inlet through which a fluid is introduced and an outlet through which the fluid is discharged, both communicating with the impeller accommodation space, and including an upper support part extending from the bottom of the inlet to be adjacent to an upper surface of the thrust plate.

The upper support part of the upper casing may include a plurality of support columns each extending from a lower inner wall of the inlet to the thrust plate, a support member mounting part formed integrally with the bottom of the plurality of support columns, and a support member coupled to the support member mounting part to have its bottom protruding downward from the support member mounting part and disposed to be adjacent to the thrust plate.

One of the upper surface of the thrust plate and a lower surface of the support member may be formed as a convex curved surface in a direction in which these surfaces face each other.

The upper surface of the thrust plate may be formed as a flat surface and the lower surface of the support member may be formed as the convex curved surface.

The upper surface of the thrust plate may be formed as the convex curved surface, and the lower surface of the support member may be formed as a flat surface.

The upper surface of the thrust plate may be formed as an entire convex curved surface or a partial convex curved surface.

The top of the shaft may be formed as an upward convex curved surface, and the lower surface of the thrust plate may be formed as a flat surface.

The thrust plate may be formed integrally with the impeller by having its radially outer side embedded in the impeller.

The thrust plate may have a center thicker than its part embedded in the impeller.

The thrust plate may include a communication hole passing through the upper and lower surfaces of the thrust plate, and the communication hole may be disposed at a position corresponding to the through hole of the rotor and disposed at a position spaced radially outward from a center of the thrust plate.

When the impeller is rotated, the fluid introduced into the inlet may partially flow downward from a fluid discharge side of the impeller, along a space between the impeller, the rotor, and the lower casing, and then flow upward along a space between the rotor and the shaft to thus flow to a fluid introduction side of the impeller through the communication hole of the thrust plate.

The shaft may include a fixing shaft extending vertically and a fixing plate formed to be perpendicular to the bottom of the fixing shaft and extending integrally with the fixing shaft, and the fixing plate may be embedded in and fixed to the bottom of the rotor accommodation part.

A bushing may be inserted and fixed into the through hole of the rotor, and the shaft may be inserted into the bushing.

The bushing may be formed as a single body having a relatively long length in a vertical direction compared to its outer diameter, and the bushing may be disposed over an area from the upper to lower sides of the rotor.

The pump may further include: a motor housing coupled to the bottom of the lower casing; and a stator disposed inside the motor housing and fitted to an outer side of the rotor accommodation part of the lower casing.

DETAILED DESCRIPTION OF EMBODIMENTS

Hereinafter, an electric water pump according to the present disclosure is described in detail with reference to the accompanying drawings.

Figure 1:
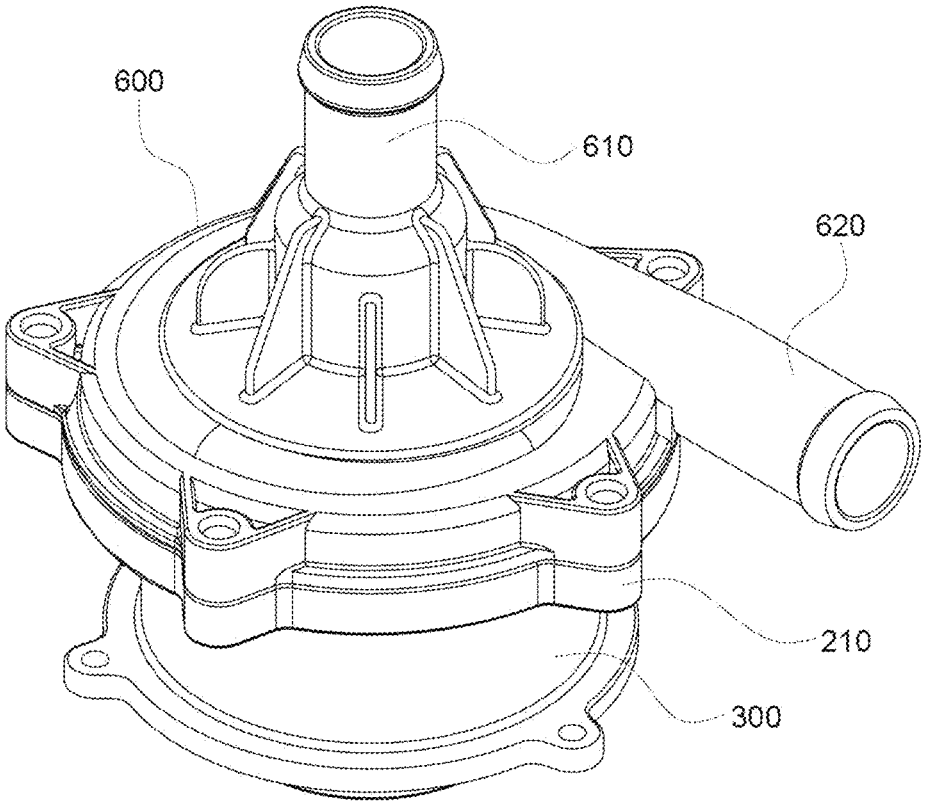
FIGS. 1 to 3 respectively show an assembled perspective view, an exploded perspective view, and a front cross-sectional view of an electric water pump according to an embodiment of the present disclosure.
Figure 2:
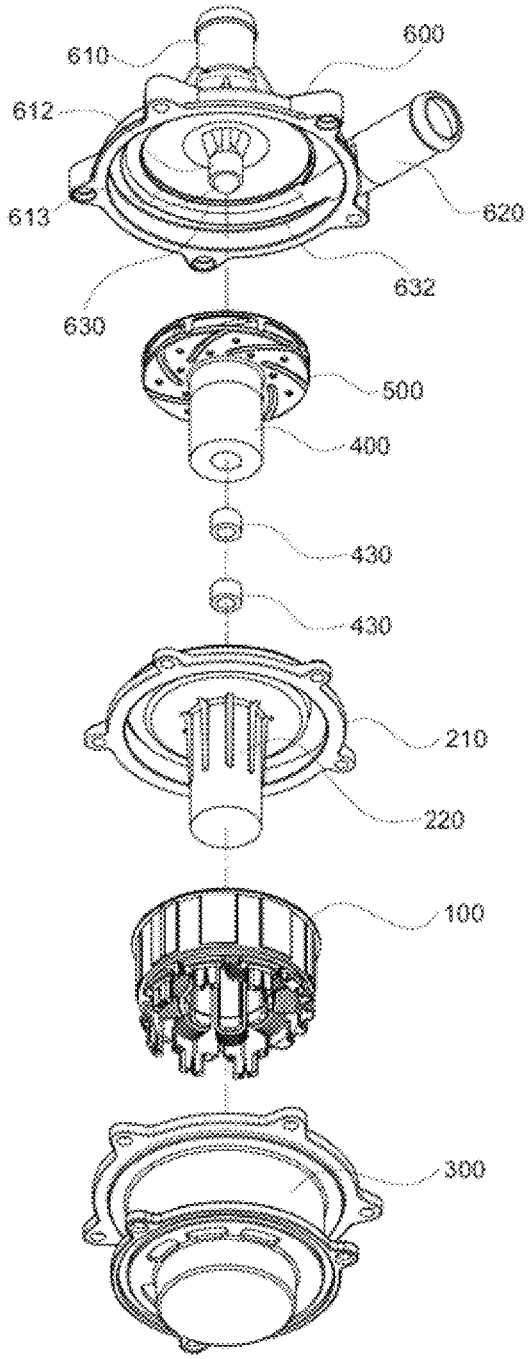
Figure 3:
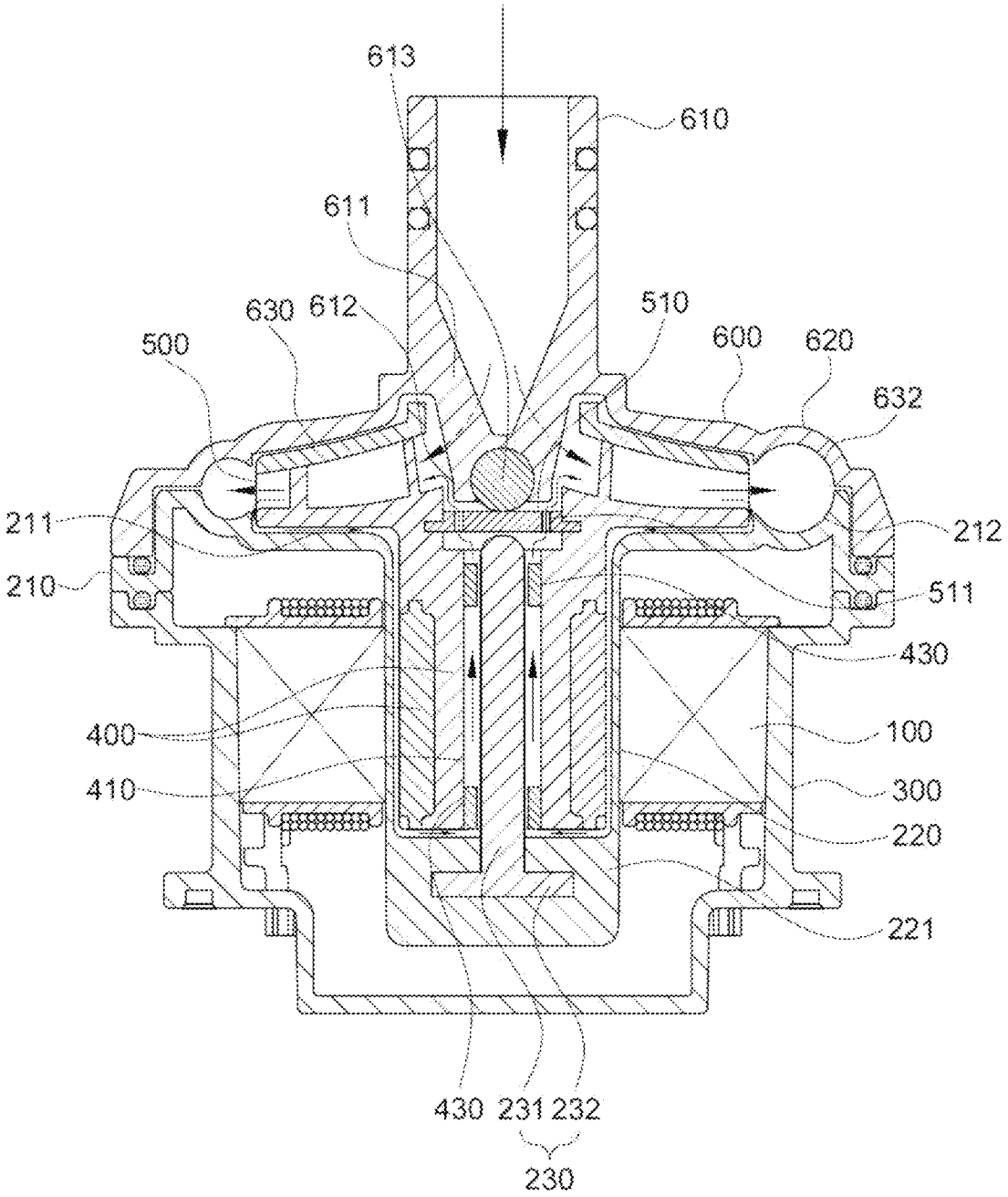
Figure 4:
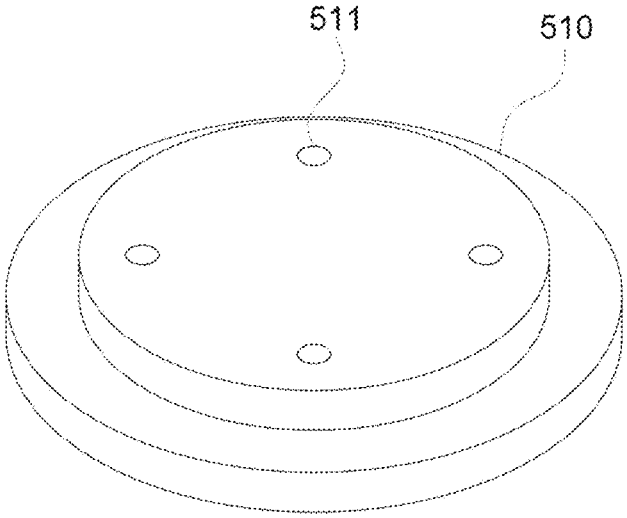
FIG. 4 is a perspective view of a thrust plate in the electric water pump according to an embodiment of the present disclosure.

FIGS. 1 to 3 respectively show an assembled perspective view, an exploded perspective view, and a front cross-sectional view of an electric water pump according to an embodiment of the present disclosure, and FIG. 4 is a perspective view of a thrust plate in the electric water pump according to an embodiment of the present disclosure.

As shown in the drawings, the electric water pump according to an embodiment of the present disclosure may include a lower casing 210, a shaft 230, an impeller 500 having a thrust plate 510 coupled thereto, a rotor 400, and an upper casing 600, and may further include a motor housing 300 and a stator 100.

The lower casing 210 may include a lower seating groove 211 formed to be concave downward from an upper surface to accommodate a portion of the impeller 500, and a lower flow groove 212 may be formed to be concave from an outer side of the lower seating groove 211 in a radial direction to enable a fluid discharged from the impeller 500 to flow. A rotor accommodation part 220 may protrude downward from the center of a part where the lower seating groove 211 is formed, and have a rotor accommodation space formed to be concave downward from the upper surface.

The shaft 230 may be disposed in the rotor accommodation space inside the rotor accommodation part 220. The shaft 230 may have its bottom coupled and fixed to a bottom 221 of the rotor accommodation part 220, and may be formed integrally with the lower casing 210 by insert molding. In addition, the shaft 230 may include a fixing shaft 231 and a fixing plate 232. The fixing shaft 231 may extend vertically and the fixing plate 232 may be formed to be perpendicular to the bottom of the fixing shaft 231 and formed integrally with the fixing shaft 231. In addition, the shaft 230 may be insert-molded to have the bottom of the fixing shaft 231 and the fixing plate 232, embedded in the bottom 221 of the rotor accommodation part 220. Accordingly, only the bottom of the shaft 230 may be fixed to the rotor accommodation part 220, and the top of the shaft 230 may be a free end. In addition, the top of the shaft 230 may have an upward convex curved surface or a spherical shape.

The impeller 500 may serve to pump the fluid by its rotation. The impeller 500 may include an upper plate, a lower plate, and blades, and the plurality of blades may be spaced apart from each other along a circumferential direction and disposed between the upper plate and the lower plate, which are spaced apart from each other in the vertical direction. In addition, the impeller 500 may have an opening formed in a central upper side, through which the fluid is introduced, and the fluid may be discharged near an outer periphery of the impeller 500. That is, the impeller may be a centrifugal impeller. In addition, the impeller 500 may be formed integrally with the rotor 400.

The rotor 400 may be disposed at a lower side of the impeller 500 and formed integrally with the impeller 500. The rotor 400 may be inserted into the rotor accommodation space inside the rotor accommodation part 220, and the rotor 400 may have a through hole 410 formed in its center in the vertical direction to enable the shaft 230 to be inserted into the through hole 410. Here, a pair of bushings 430 may be inserted and fixed into the through hole 410 of the rotor 400. The pair of bushings 430 may be disposed to be spaced apart from each other in the vertical direction, and the shaft 230 may be inserted into the pair of bushings 430 to enable the rotor 400 and the impeller 500 to be rotated smoothly around the shaft 230.

The thrust plate 510 may be coupled to the impeller 500 and, for example, the thrust plate 510 may be formed integrally with the impeller 500 by the insert molding. For example, the thrust plate 510 may be formed in a disc shape, and formed integrally with the impeller 500 by having its radially outer side embedded in the impeller 500. In addition, an upper surface of the thrust plate 510 may be exposed to the opening, which is the central upper side of the impeller 500, and a lower surface of the thrust plate 510 may be exposed to the through hole 410 of the rotor 400. In addition, each of the upper and lower surfaces of the thrust plate 510 may be formed as a flat surface.

The upper casing 600 may be coupled to the top of the lower casing 210, and an impeller accommodation space for accommodating the impeller 500 may be formed inside between the upper casing 600 and the lower casing 210 by coupling the upper casing 600 to the lower casing 210.

In addition, an upper seating groove 630 may be formed to be concave upward from a lower surface of the upper casing 600 to accommodate a portion of the impeller 500, and, accordingly, the lower seating groove 211 and the upper seating groove 630 may form an impeller accommodation space. In addition, an upper flow groove 632 may be formed to be concave from the lower surface of the upper casing 600 to enable the fluid discharged from the impeller 500 to flow to a position corresponding to a lower flow groove 212 of the lower casing 210. In addition, the upper casing 600 may include an inlet 610 through which the fluid is introduced and an outlet 620 through which the fluid is discharged. The inlet 610 may have an inflow path formed therein and the outlet 620 may have a discharge path formed therein. In addition, the upper casing 600 may have the center open vertically to enable the upper seating groove 630 and the inflow path of the inlet 610 to communicate with each other, and to enable the upper flow groove 632 and the lower flow groove 212 to communicate with the discharge path of the outlet 620. Here, the upper casing 600 may have an upper support part extending from the bottom of the inlet 610 to be adjacent to the upper surface of the thrust plate 510. The upper support part may include a plurality of support columns 611, a support member mounting part 612, and a support member 613. The plurality of support columns 611 may each extend from a lower inner wall of the inlet 610 to the thrust plate 510, and the support member mounting part 612 may be formed integrally with and connected to the bottom of the plurality of support columns 611. The support member mounting part 612 may have a groove formed to be concave upward from the bottom, and the support member 613 may be inserted and fixed into the groove of the support member mounting part 612. In addition, the support member 613 may protrude downward from the bottom of the support member mounting part 612, and the bottom of the support member 613 may be disposed to be adjacent to or in contact with the upper surface of the thrust plate 510.

The motor housing 300 may have a shape of a concave container, an empty inside, and an open upper side. In addition, the motor housing 300 may be coupled to the bottom of the lower casing 210.

The stator 100 may be disposed inside the motor housing 300, and an outer peripheral surface of a core of the stator 100 may be in contact with and coupled to an inner peripheral surface of the motor housing 300. In addition, the stator 100 may have the center open in the vertical direction, and the stator 100 may thus be coupled to the rotor accommodation part 220 by being fitted to its outer side.

Accordingly, the electric water pump according to the present disclosure may have improved rotational stability because the impeller and the rotor are supported on both sides of a central axis, and also minimize frictional force occurring between parts in contact with each other and rotated relatively in a direction of the central axis, thereby improving efficiency of the electric water pump and reducing noise.

In addition, the thrust plate 510 may have the center thicker than its part embedded in the impeller 500. For example, as shown in the drawings, the thrust plate 510 may have another disc having a relatively small outer diameter and protruding upward from the center of one disc having a relatively large outer diameter. Therefore, a relatively thin outer part of the thrust plate 510 in the radial direction may be easily embedded in the impeller 500, and the relatively thick central part may be supported by the support member 613 and the top of the shaft 230, thereby improving the structural rigidity and durability of the thrust plate 510. In addition, the thrust plate 510 may be formed in various forms.

In addition, the thrust plate 510 may include a communication hole 511 passing through the upper and lower surfaces of the thrust plate 510. The communication hole 511 may be disposed at a position corresponding to the through hole 410 of the rotor 400, and the communication hole 511 may be disposed at a position spaced radially outward from the center of the thrust plate 510. In addition, the plurality of communication holes 511 may be provided, and the plurality of communication holes 511 may be disposed to be spaced apart from each other along the circumferential direction.

In addition, the impeller 500 may be disposed in the impeller accommodation space formed by coupling the lower casing 210 to the upper casing 600, and the impeller 500, which is provided to be rotatable, may have a clearance that allows the impeller 500 to be moved slightly in the vertical direction within the impeller accommodation space. In addition, the rotor 400 may be rotatably provided inside the rotor accommodation part 220, and a clearance may thus exist between an outer peripheral surface of the rotor 400 and an inner peripheral surface of the rotor accommodation part 220. Similarly, a clearance may also exist between a lower surface of the rotor 400 and the bottom 221 of the rotor accommodation part 220.

Therefore, when the impeller 500 is rotated, the fluid introduced into the inlet 610 of the upper casing 600 may partially flow downward from a fluid discharge side of the impeller 500, along a space between the impeller 500, the rotor 400, and the lower casing 210, and then flow upward along a space between the rotor 400 and the shaft 230 to thus flow to a fluid introduction side of the impeller 500 through the communication hole 511 of the thrust plate 510. Here, the fluid may pass through a minute gap between the bushing 430 and the shaft 230, and the rotor 400 may have the path formed in the vertical direction at its part where the bushing 430 is coupled, thus enabling the fluid to pass therethrough. Accordingly, a fluid pressure difference occurring between the upper and lower sides of the impeller may be reduced, thereby reducing the occurrence of thrust.

Figure 5:
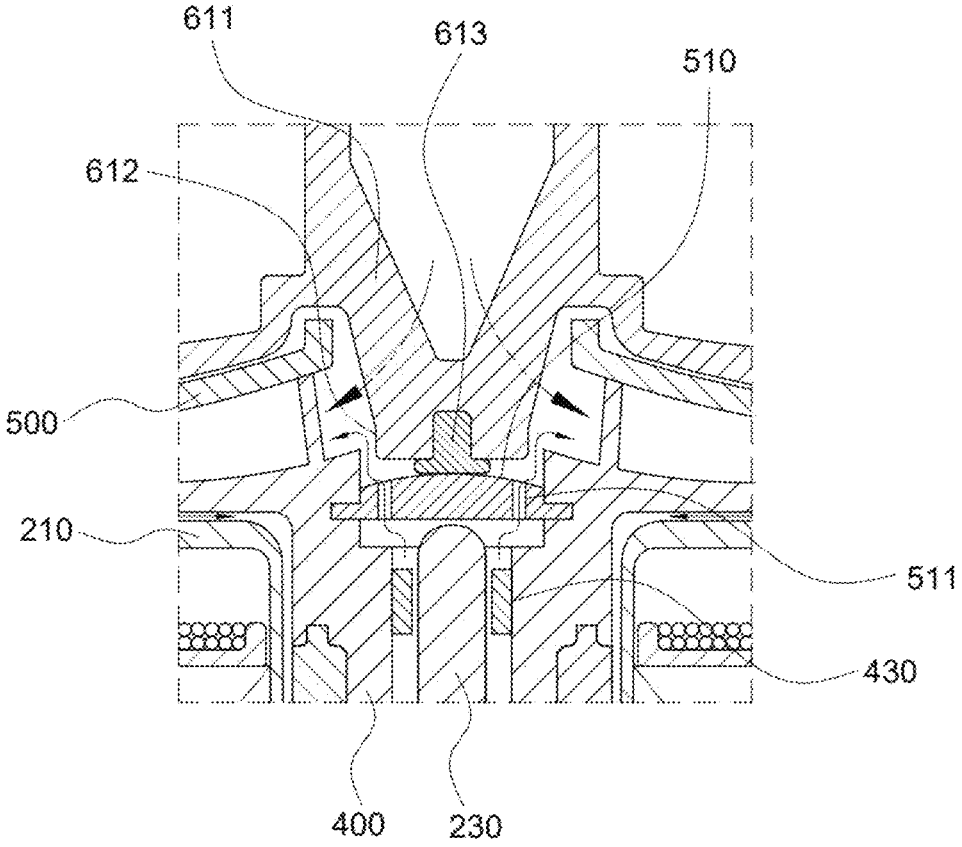
FIGS. 5 and 6 are front cross-sectional views of other embodiments of the thrust plate and a support member in the electric water pump according to an embodiment of the present disclosure.
Figure 6:
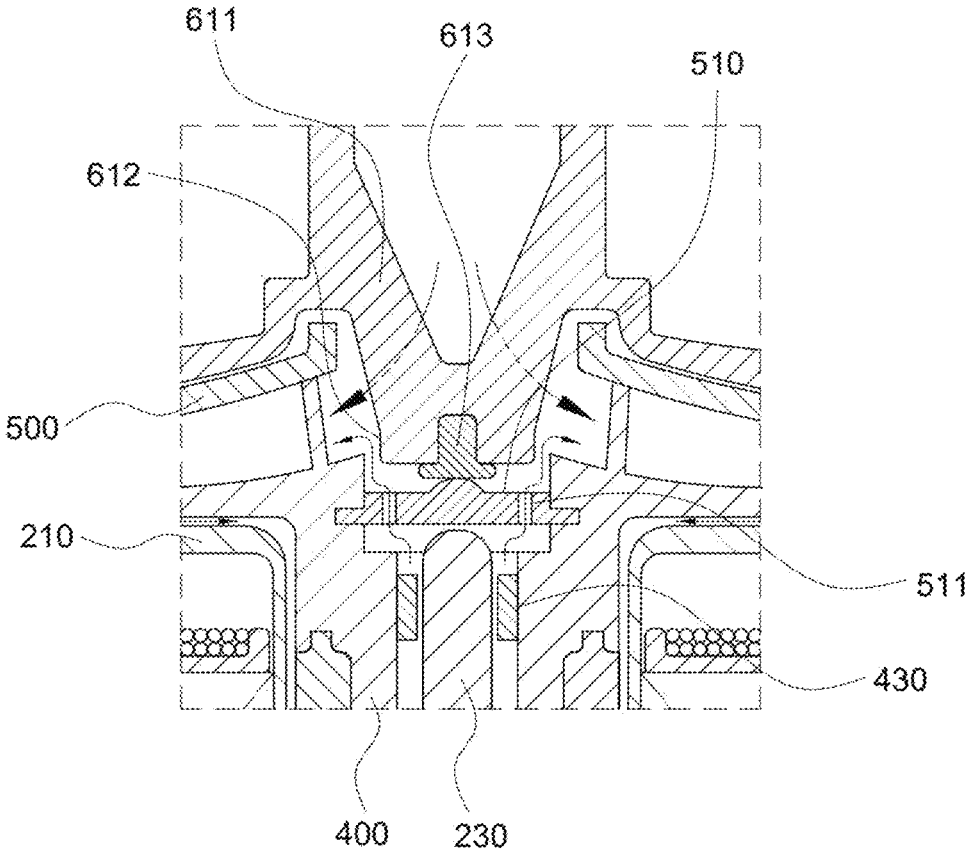

FIGS. 5 and 6 are front cross-sectional views of other embodiments of the thrust plate and the support member in the electric water pump according to an embodiment of the present disclosure.

As shown in the drawings, one of the upper surface of the thrust plate 510 and a lower surface of the support member 613, which are surfaces facing each other, may be formed as a convex curved surface in a direction in which these faces face each other. For example, as shown in FIG. 3, the upper surface of the thrust plate 510 may be formed as the flat surface and the lower surface of the support member 613 may be formed as the convex curved surface. Here, the support member 613 may be a ball. Alternatively, as shown in FIGS. 5 and 6, the upper surface of the thrust plate 510 may be formed as an upward convex curved surface, and the lower surface of the support member 613 may be formed as a flat surface. Here, the support member 613 may be a thrust pin. In addition, the upper surface of the thrust plate 510 may be formed as an entire convex surface as in FIG. 5 or as a partial convex curved surface as in FIG. 6. In addition, the top of the shaft 230 may be formed as an upward convex curved surface and the lower surface of the thrust plate 510 may be formed as the flat surface. Accordingly, the upper surface of the thrust plate 510 and the lower surface of the support member 613 may easily come into point contact with each other.

Figure 7:
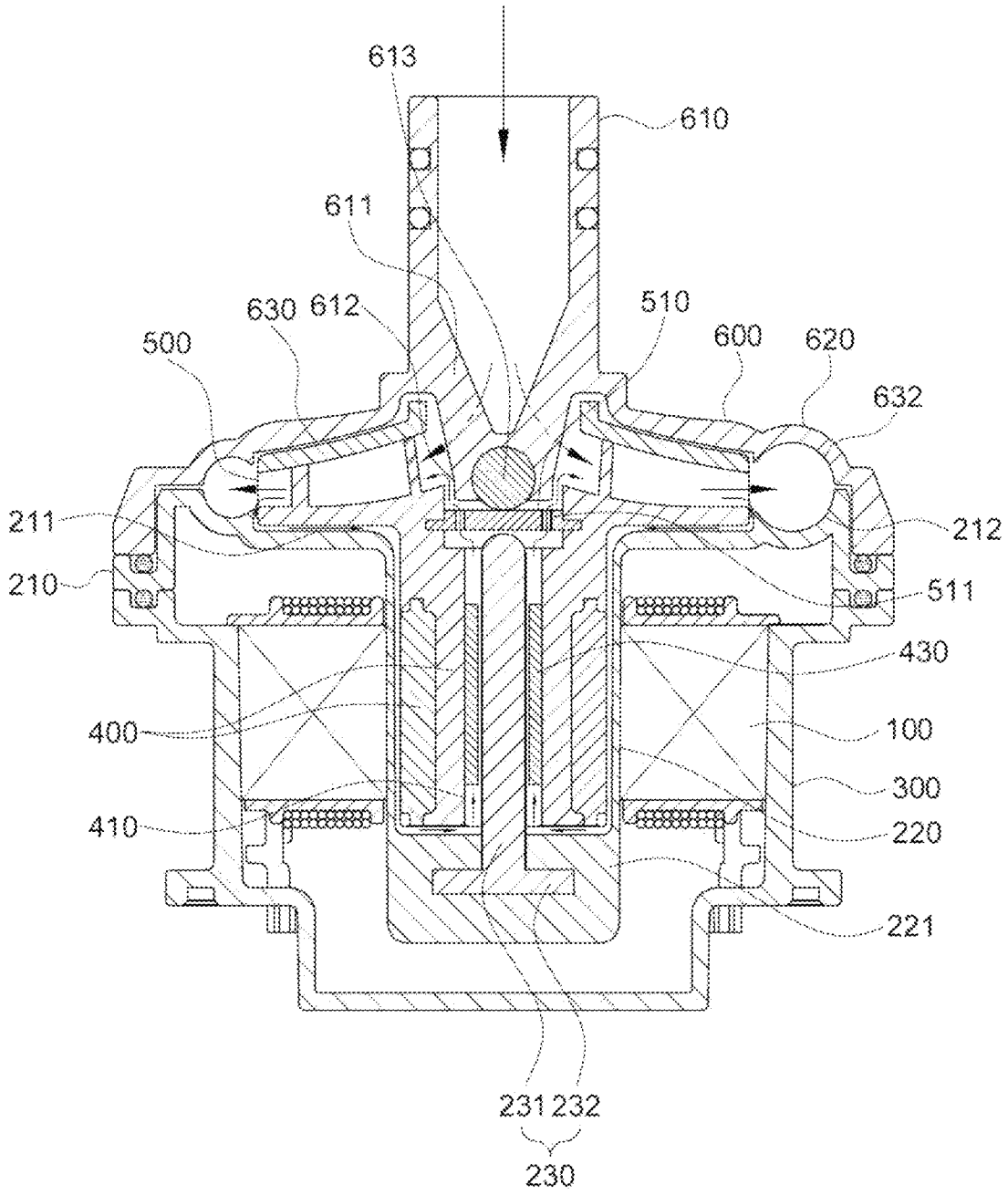
FIG. 7 is a front cross-sectional view of another embodiment of a bushing in the electric water pump according to an embodiment of the present disclosure.

FIG. 7 is a front cross-sectional view of another embodiment of the bushing in the electric water pump according to an embodiment of the present disclosure.

As shown in the drawings, the bushing 430 may be formed as a single body having a relatively long length in the vertical direction compared to its outer diameter, and the bushing 430 may be disposed over an area from the upper to lower sides of the rotor 400. The reason is that when the impeller 500 and the thrust plate 510 are integrally formed on the upper side of the rotor 400 by the insert molding, the bushing 430 needs to be pressed into and coupled to the through hole 410 from the lower side of the rotor 400 toward the upper side. Accordingly, inserting and coupling the single long bushing 430 may be more efficient than coupling the pair of relatively short bushings into the through hole 410.

As set forth above, the electric water pump according to the present disclosure may include the impeller and the rotor supported on both the sides of the central axis, and the frictional force occurring between the parts in contact with each other and rotated relatively may be minimized, thereby improving the efficiency and reducing noise.

The present disclosure is not limited to the above-described embodiments, and may be variously applied. In addition, the present disclosure may be variously modified by those skilled in the art to which the present disclosure pertains without departing from the gist of the present disclosure claimed in the claims.

What is claimed is:

1. An electric water pump comprising:

a lower casing including a rotor accommodation part protruding downward and having a rotor accommodation space formed to be concave downward from an upper surface;

a shaft disposed inside the rotor accommodation part of the lower casing and having its bottom fixed to a bottom of the rotor accommodation part and extending upward;

an impeller disposed on a top of the lower casing and having a thrust plate coupled to its center to dispose a lower surface of the thrust plate to be supported on a top of the shaft;

a rotor formed integrally with the impeller, having a through hole formed in its center and open vertically to enable the shaft to be inserted into the through hole, and inserted into the rotor accommodation space of the lower casing to be rotatable together with the impeller; and an upper casing coupled to the top of the lower casing, forming an impeller accommodation space therein by being coupled with the lower casing, including an inlet through which a fluid is introduced and an outlet through which the fluid is discharged, both communicating with the impeller accommodation space, wherein the upper casing including an upper support part extending from a bottom of the inlet to be adjacent to an upper surface of the thrust plate.

2. The pump of claim 1, wherein the upper support part of the upper casing includes a plurality of support columns each extending from a lower inner wall of the inlet to the thrust plate, a support member mounting part formed integrally with a bottom of the plurality of support columns, and a support member coupled to the support member mounting part to have its bottom protruding downward from the support member mounting part and disposed to be adjacent to the thrust plate.

3. The pump of claim 2, wherein one of the upper surface of the thrust plate and a lower surface of the support member is formed as a convex curved surface in a direction in which these surfaces face each other.

4. The pump of claim 3, wherein the upper surface of the thrust plate is formed as a flat surface and the lower surface of the support member is formed as the convex curved surface.

5. The pump of claim 3, wherein the upper surface of the thrust plate is formed as the convex curved surface, and the lower surface of the support member is formed as a flat surface.

6. The pump of claim 5, wherein the upper surface of the thrust plate is formed as an entire convex curved surface or a partial convex curved surface.

7. The pump of claim 1, wherein the top of the shaft is formed as an upward convex curved surface, and the lower surface of the thrust plate is formed as a flat surface.

8. The pump of claim 1, wherein the thrust plate is formed integrally with the impeller by having its radially outer side embedded in the impeller.

9. The pump of claim 8, wherein the thrust plate has a center thicker than its part embedded in the impeller.

10. The pump of claim 1, wherein the thrust plate includes a communication hole passing through the upper and lower surfaces of the thrust plate, and the communication hole is disposed at a position corresponding to the through hole of the rotor and disposed at a position spaced radially outward from a center of the thrust plate.

11. The pump of claim 10, wherein when the impeller is rotated, the fluid introduced into the inlet partially flows downward from a fluid discharge side of the impeller, along a space between the impeller, the rotor, and the lower casing, and then flows upward along a space between the rotor and the shaft to thus flow to a fluid introduction side of the impeller through the communication hole of the thrust plate.

12. The pump of claim 1, wherein the shaft includes a fixing shaft extending vertically and a fixing plate formed to be perpendicular to a bottom of the fixing shaft and extending integrally with the fixing shaft, and the fixing plate is embedded in and fixed to the bottom of the rotor accommodation part.

13. The pump of claim 1, wherein a bushing is inserted and fixed into the through hole of the rotor, and the shaft is inserted into the bushing.

14. The pump of claim 13, wherein the bushing is formed as a single body having a relatively long length in a vertical direction compared to its outer diameter, and the bushing is disposed over an area from an upper side to a lower side of the rotor.

15. The pump of claim 1, further comprising:

a motor housing coupled to a bottom of the lower casing; and a stator disposed inside the motor housing and fitted to an outer side of the rotor accommodation part of the lower casing.

* * * * *